US007266979B2

(12) United States Patent
Belden, Jr.

(10) Patent No.: US 7,266,979 B2
(45) Date of Patent: Sep. 11, 2007

(54) THEFT DETERRENT DEVICE

(75) Inventor: Dennis D. Belden, Jr., Waxhaw, NC (US)

(73) Assignee: Alpha Security Products, Inc., Charlotte, NC (US)

( * ) Notice: Subject to any disclaimer, the term of this patent is extended or adjusted under 35 U.S.C. 154(b) by 35 days.

(21) Appl. No.: 11/191,117

(22) Filed: Jul. 27, 2005

(65) Prior Publication Data

US 2006/0021394 A1 Feb. 2, 2006

Related U.S. Application Data

(60) Provisional application No. 60/592,898, filed on Jul. 30, 2004.

(51) Int. Cl.
*E05B 65/00* (2006.01)
*B65D 85/57* (2006.01)

(52) U.S. Cl. ..... 70/57.1; 70/63; 70/276; 206/1.5; 206/308.2; 206/387.11

(58) Field of Classification Search ..... 70/14, 70/18, 19, 57.1, 58, 63, 276, 158–162; 24/517, 24/704.1; 206/1.5, 308.2, 387.11; 292/251.5; 340/572.9

See application file for complete search history.

(56) References Cited

U.S. PATENT DOCUMENTS

| | | | | | |
|---|---|---|---|---|---|
| 267,532 | A | * | 11/1882 | Horton | 70/166 |
| 517,729 | A | * | 4/1894 | Cable | 70/304 |
| 931,685 | A | * | 8/1909 | Crim et al. | 70/182 |
| 1,347,467 | A | * | 7/1920 | Scott et al. | 70/18 |
| 1,359,213 | A | * | 11/1920 | Welch | 70/183 |
| 1,409,106 | A | * | 3/1922 | Hess | 70/19 |
| 3,966,033 | A | * | 6/1976 | Doo | 194/247 |
| 3,982,413 | A | * | 9/1976 | Stone et al. | 70/229 |
| 3,995,900 | A | * | 12/1976 | Humble et al. | 70/57.1 |
| 4,000,543 | A | * | 1/1977 | Paskert | 340/572.8 |
| 4,398,404 | A | * | 8/1983 | Wake | 70/276 |
| 4,574,600 | A | * | 3/1986 | Moffett | 70/16 |
| 4,745,664 | A | * | 5/1988 | Damvig | 24/704.1 |
| 4,987,754 | A | * | 1/1991 | Minasy et al. | 70/57.1 |
| 5,524,463 | A | | 6/1996 | Schenkel et al. | |
| 5,644,937 | A | * | 7/1997 | Farino | 70/261 |

(Continued)

FOREIGN PATENT DOCUMENTS

| | | |
|---|---|---|
| GB | 2 396 382 | 6/2004 |

(Continued)

*Primary Examiner*—Lloyd A. Gall
(74) *Attorney, Agent, or Firm*—Sand & Sebolt

(57) ABSTRACT

A theft deterrent device includes first and second jaws pivotally connected to one another and pivotally movable between open and closed positions. The jaws form in the closed position an interior chamber and a through passage for receiving therethrough a portion of an article of merchandise. A lock slide is slidable within the interior chamber between locked and unlocked positions and lockable by a lock in the locked position to secure the first and second jaws together in the closed position. The lock slide includes lock hooks which lockably engage lock hooks of the second jaw. The lock slide includes locking and unlocking ledges which a resilient, magnetically attractable lock finger of the lock respectively engages in the locked and unlocked positions. An externally accessible thumb grip operatively engages the lock slide to move it between the locked and unlocked positions. An EAS tag is disposed within the device.

21 Claims, 15 Drawing Sheets

U.S. PATENT DOCUMENTS

| | | | | |
|---|---|---|---|---|
| 5,952,921 | A | 9/1999 | Donnelly | |
| 6,018,968 | A * | 2/2000 | Sides | 70/14 |
| 6,057,762 | A | 5/2000 | Dusza | |
| 6,098,256 | A | 8/2000 | Poussard | |
| 6,279,358 | B1 | 8/2001 | Costa | |
| 6,311,531 | B1 | 11/2001 | Sykes | |
| 6,326,890 | B1 | 12/2001 | Costa | |
| 6,374,647 | B1 | 4/2002 | Holmgren | |
| 7,100,402 | B2 * | 9/2006 | Holmgren | 70/57.1 |
| 2004/0172988 | A1 | 9/2004 | Gorst | |
| 2006/0070410 | A1 * | 4/2006 | Fuss et al. | 70/57.1 |

FOREIGN PATENT DOCUMENTS

| | | |
|---|---|---|
| WO | WO 03/093614 | 11/2003 |

* cited by examiner

THEFT DETERRENT DEVICE

CROSS REFERENCE TO RELATED APPLICATIONS

This application claims priority from U.S. provisional application Ser. No. 60/592,898 filed Jul. 30, 2004; the disclosure of which is incorporated herein by reference.

BACKGROUND OF THE INVENTION

1. Technical Field

The present invention generally relates to theft deterrent devices and, more particularly, to theft deterrent devices that thwart shoplifters in retail establishments. Specifically, the present invention relates to theft deterrent devices that are locked to items of merchandise and are used as benefit-denial devices or as electronic article surveillance (EAS) tag carriers.

2. Background Information

Theft deterrent devices for use with items of merchandise which are elongated or have an elongated portion to which the device is secured are known in the art generally. For instance, U.K. Patent Application GB 2 396 382 A discloses such a device having two parts 21 and 22 which are pivotally connected to one another such that these parts in a closed position may be locked onto such articles of merchandise, for instance the handle of a golf club. However, the security of the '382 application requires the use of a key such as key 51, a portion of which must be inserted through an opening in the device in order to unlock parts 21 and 22 from one another. Thus, there is still room for improvement for such a theft deterrent device having an improved locking mechanism which reduces the ability to tamper with the device. The theft deterrent device of the present invention provides such an improvement along with other advantages.

BRIEF SUMMARY OF THE INVENTION

The invention provides a theft deterrent device comprising first and second jaws pivotally connected to one another and pivotally movable between open and closed positions; wherein the jaws cooperate when in the closed position to define an interior chamber and a through passage adapted to receive there through a portion of an article of merchandise; a lock slide disposed within the interior chamber and carried by the first jaw; wherein the lock slide is slidable between locked and unlocked positions; and a lock for selectively locking the lock slide in its locked position to lockably secure the first and second jaws together in the closed position.

BRIEF DESCRIPTION OF THE SEVERAL VIEWS OF THE DRAWINGS

Similar numbers refer to similar parts throughout the specification.

DETAILED DESCRIPTION OF THE INVENTION

Figure 1:
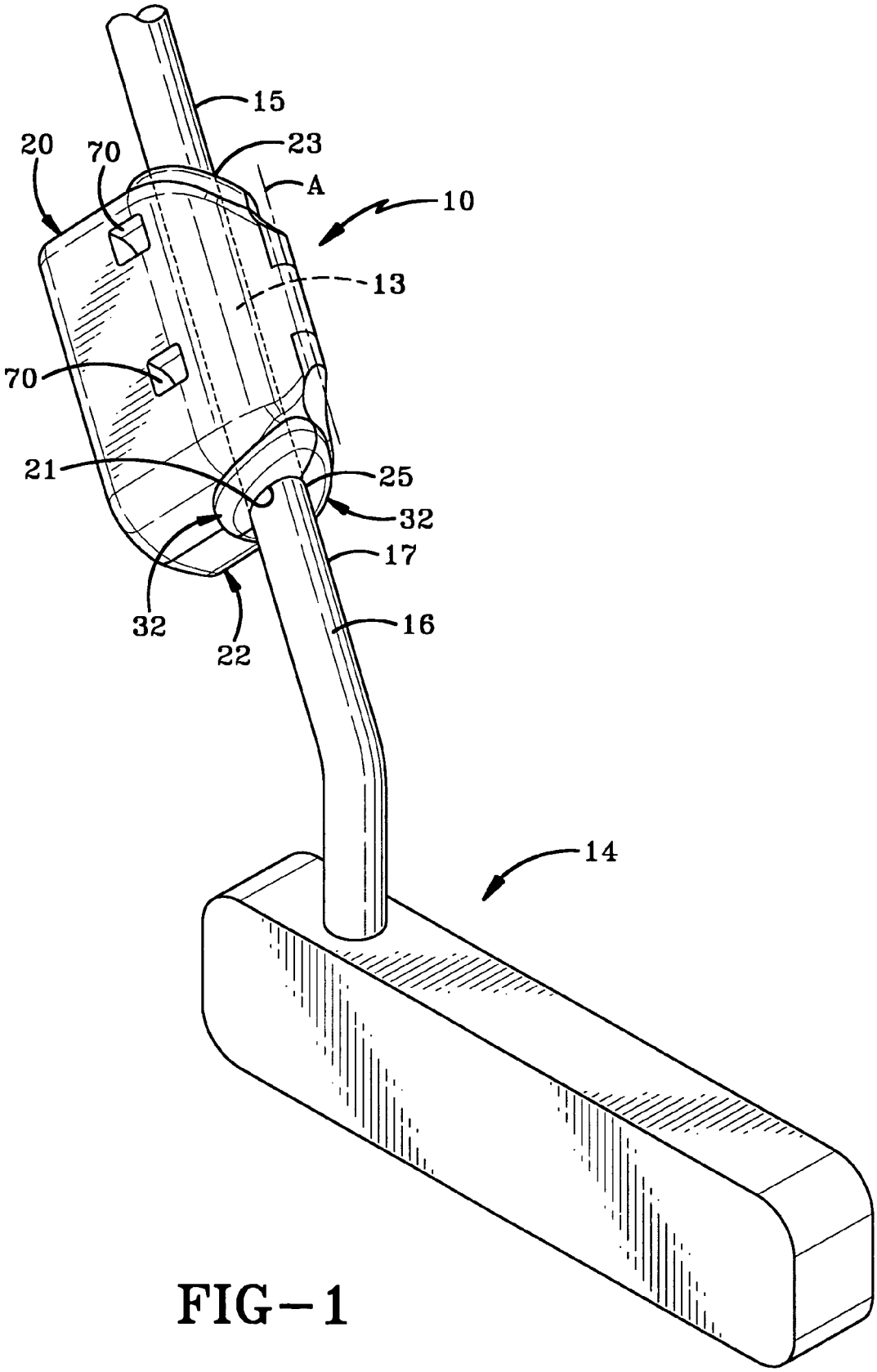
FIG. 1 is a perspective view of the theft deterrent tag of the invention locked to an exemplary item of merchandise.

The theft deterrent device of the present invention is indicated generally by the numeral 10 in the accompanying drawings. Device 10 is used to thwart shoplifters by securely attaching an electronic article surveillance (EAS) tag 12 to an item or article of merchandise 14 in a manner that prevents the shoplifter from removing tag 12 from item 14. Device 10 may also be used without EAS tag 12 simply to frustrate the shoplifter by removing some of the value of item 14 because the shoplifter would have to forcefully remove device 10 from item 14. In the exemplary embodiment of the invention, item 14 is a golf club having a relatively thin, cylindrical shaft 16. Theft deterrent device 10 may be configured to work with a wide variety of items 14 having elongated elements similar to shaft 16. For example, device 10 may be configured to work with fishing rods, baseball bats, luggage handles, golf bag straps, and the like. Although the exemplary EAS tag 12 is in the form of a RF coil, any of a wide variety of EAS tags 12 may be used with device 10.

Figure 2:
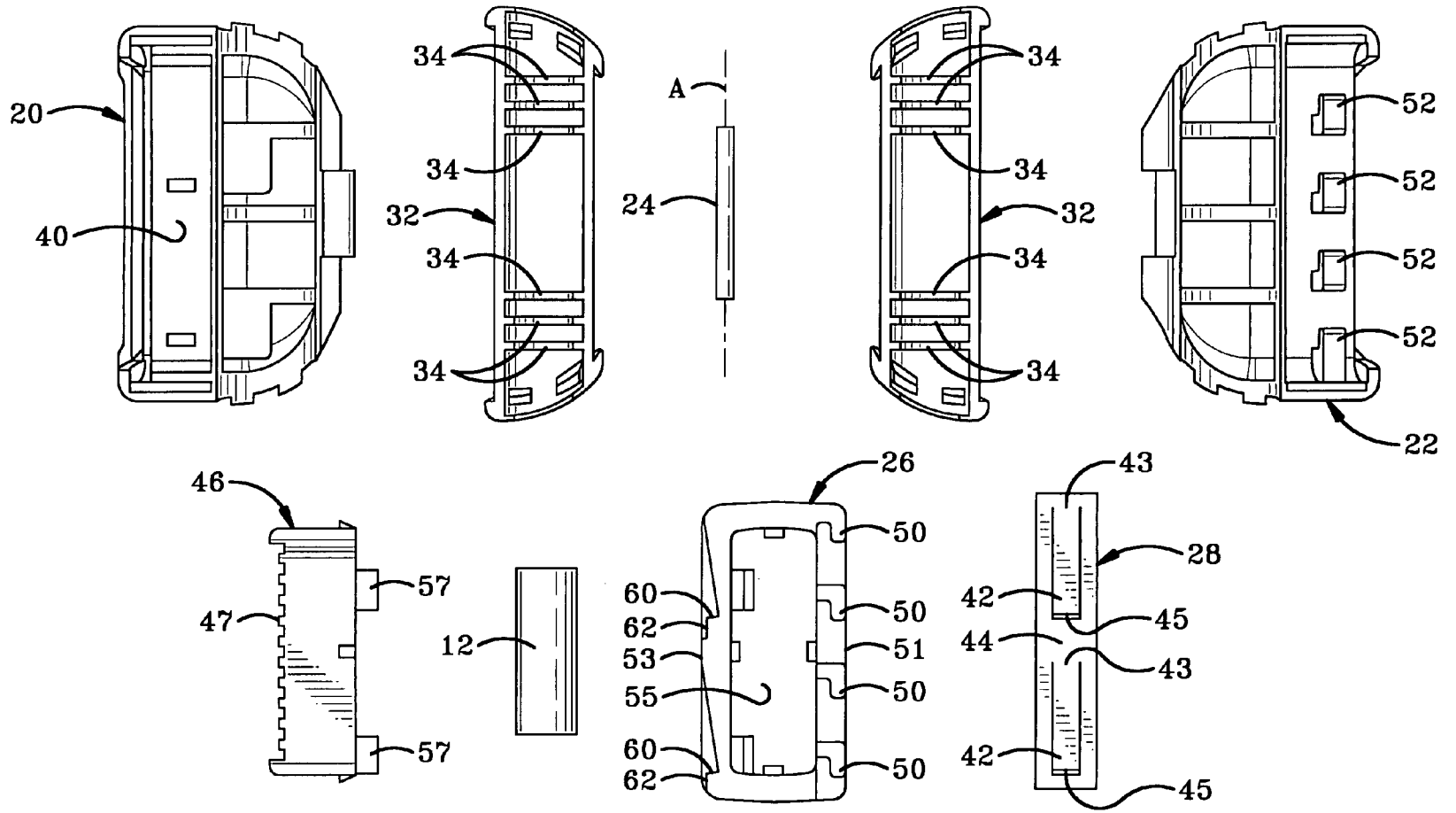
FIG. 2 is an exploded view of the theft deterrent tag shown in FIG. 1.
Figure 3:
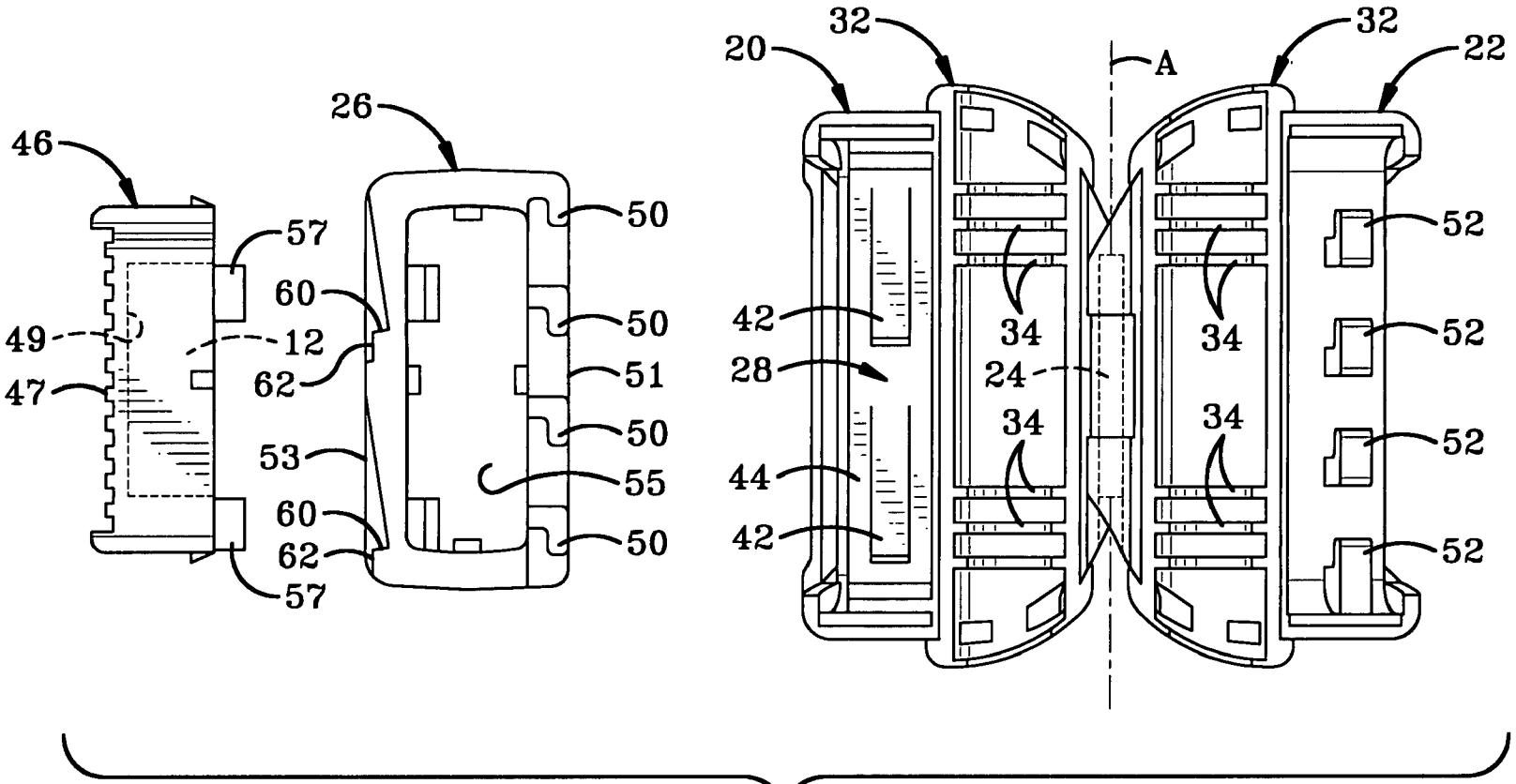
FIG. 3 is an exploded view similar to FIG. 2 showing the assembly of the jaws.
Figure 10:
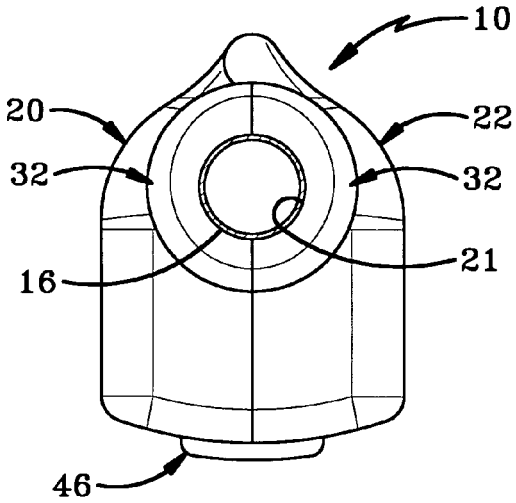
FIG. 10 is a front elevation view of the theft deterrent device locked to an exemplary item of merchandise.
Figure 11:
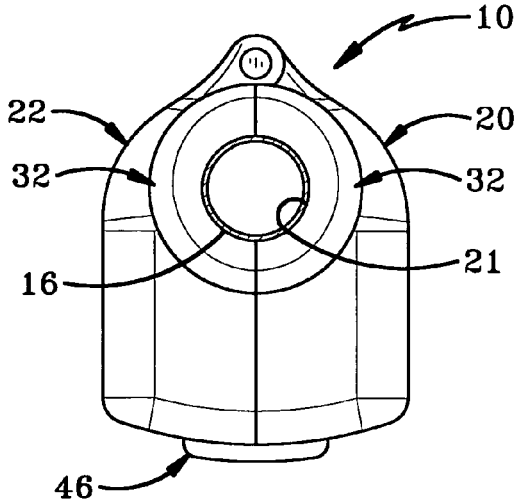
FIG. 11 is a rear elevation view showing the theft deterrent device locked to an exemplary item of merchandise.
Figure 12:
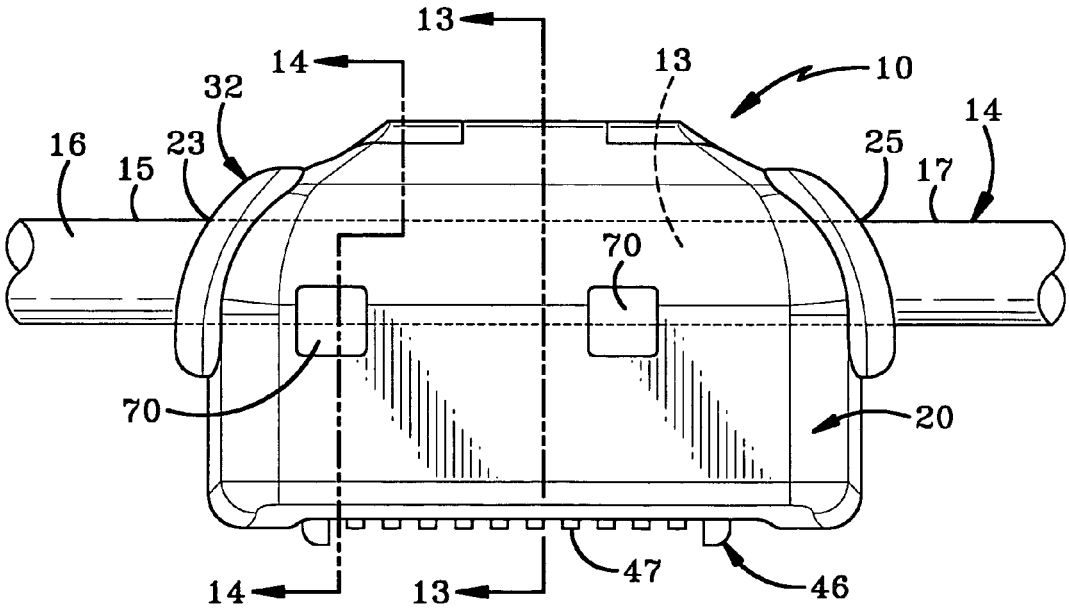
FIG. 12 is a side elevation view of FIG. 10.
Figure 14:
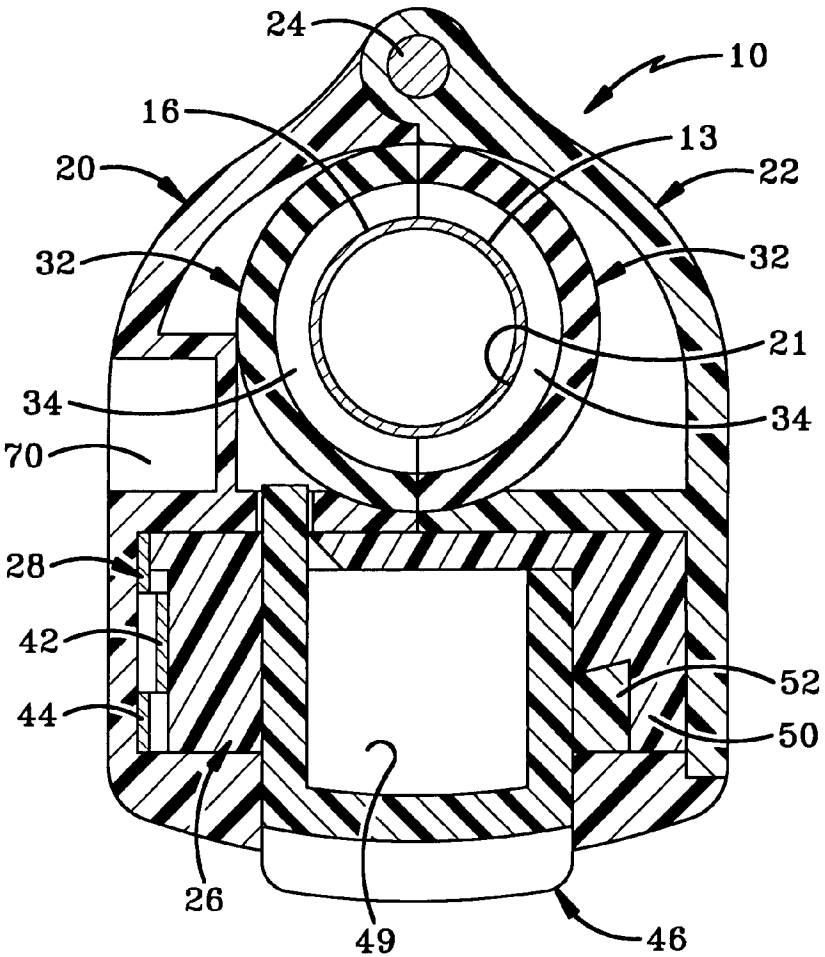
FIG. 14 is a section view taken along line 14-14 of FIG. 12.
Figure 13:
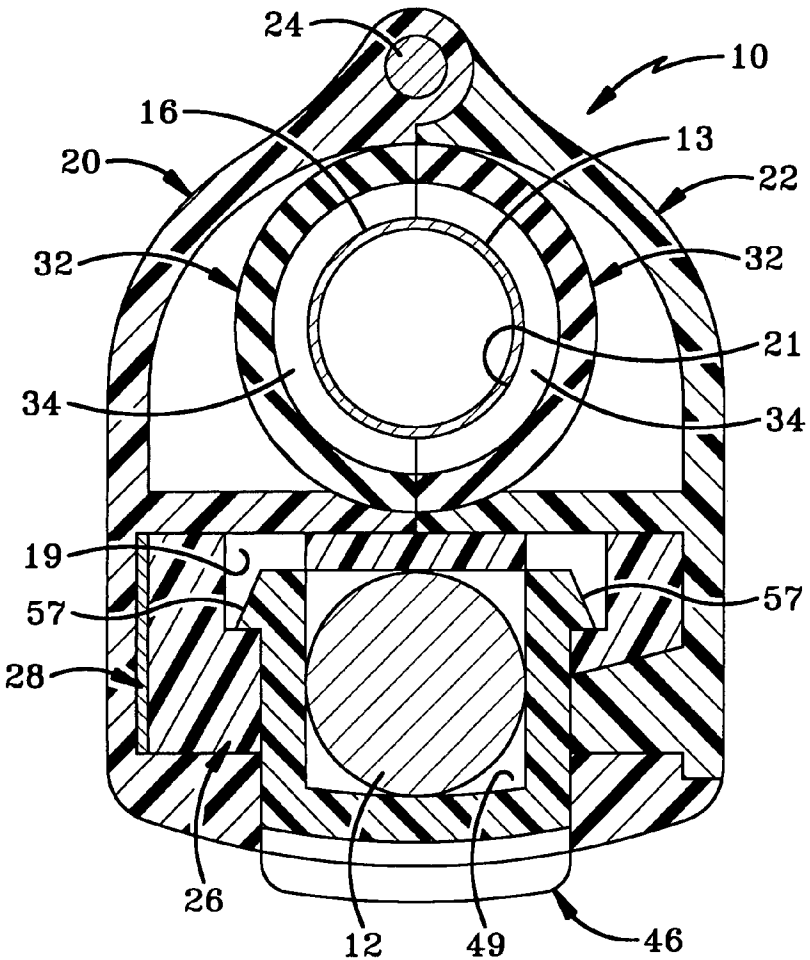
FIG. 13 is a section view taken along line 13-13 of FIG. 12.

With reference to FIGS. 2-3, device 10 generally includes first 20 and second 22 rigid jaws that are connected together with a hinge pin 24 so that jaws 20 and 22 may pivot about hinge pin 24 or longitudinal axis A thereof between open and closed positions. Jaws 20 and 22 cooperate in the closed position to define an interior chamber 19 (FIGS. 7, 13) and a through passage 21 (FIGS. 1, 10, 13) for receiving therethrough a portion of an item of merchandise such as elongated shaft 16. More particularly, through passage 21 has first and second opposed open ends 23 and 25 (FIG. 1) so that a first portion 13 of shaft 16 is enclosed within through passage 21, a second portion 15 of shaft 16 extends outwardly from first open end 23 in a first direction and a third portion 17 of shaft 16 extends outwardly from second open end 25 in a second direction generally opposite that of the first direction.

With continued reference to FIGS. 2-3, first jaw 20 carries a lock slide 26 which is disposed within interior chamber 19 (FIGS. 7, 13) and moves between locked and unlocked positions in a direction substantially parallel to axis A. A lock 28 is used to selectively retain lock slide 26 in the locked position to lockably secure the first and second jaws together in the closed position. When jaws 20 and 22 are closed and lock slide 26 is in the locked position, lock slide 26 secures jaw 22 to jaw 20 so that jaws 20 and 22 cannot be opened unless a specially designed key 30 (FIG. 15) is used to unlock lock 28. The term "lock" is used in this application to mean that a key is required to change the state from locked to unlocked. The term "latched" is used to describe a connection between two elements where a key is not required to undo the connection.

Device 10 optionally includes a pair of padded sleeve halves 32 that protect item 14 from scratches that could be caused when device 10 is secured to item 14. Sleeve halves 32 may be fabricated from a resilient material so that a clamping force is required to secure device 10 to item 14. The resilient force is created when sleeve halves 32 are compressed against item 14. The resilient force helps secure device 10 in place so that it does not rattle or slide up and down with respect to item 14 thus protecting item 14 from minor damage when customers handle merchandise 14. Sleeve halves 32 may be fabricated from a resilient material such as rubber, elastomers, cloths, foams, plastics, and the like. Each sleeve halve 32 is secured to a jaw 20 or 22 with resilient latching fingers. Each sleeve halve 32 may optionally include a plurality of ribs 34 that collapse against item 14 when device 10 is clamped around item 14.

Figure 4:
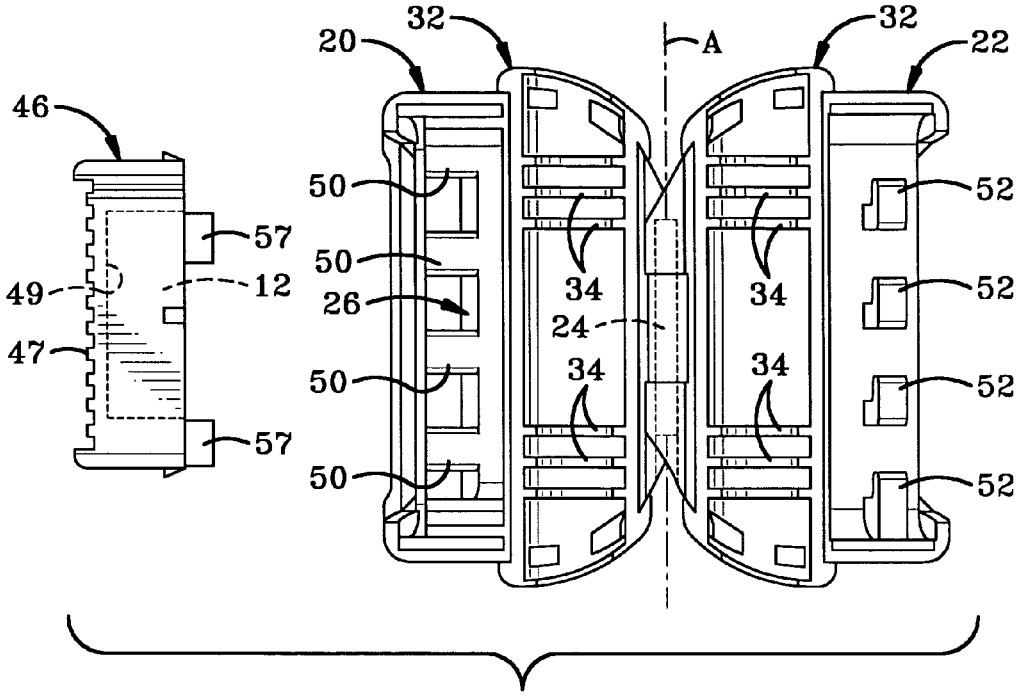
FIG. 4 is an exploded view similar to FIG. 3 showing the lock slide installed in one of the jaws.
Figure 9:
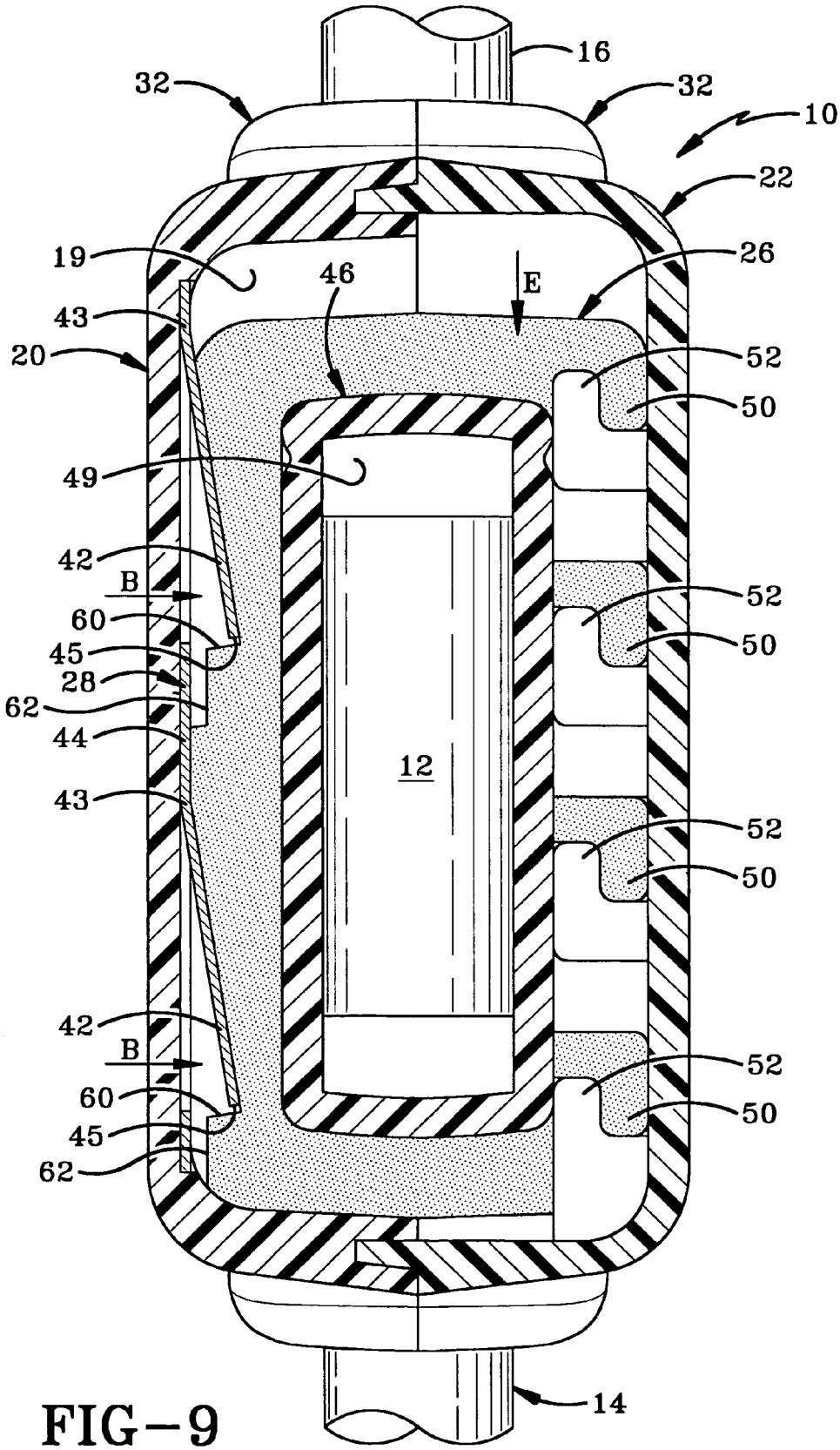
FIG. 9 is a view similar to FIG. 7 showing the lock slide in the locked position.

The assembly of device 10 may be seen by reviewing FIGS. 2-5. FIG. 2 shows the disassembled pieces of device 10 with FIG. 3 showing jaws 20 and 22 connected together with hinge pin 24 and lock 28 being placed against a substantially flat lock reception wall 40 defined by first jaw 20. In the exemplary embodiment of the invention, lock 28 includes a pair of spaced substantially flat lock fingers 42 that resiliently project from a substantially flat common lock frame 44. Frame 44 lays substantially flat against lock reception wall 40. Each lock finger 42 is cantilevered at a first end 43 thereof from lock frame 44 and includes a free end 45 which is movable between a retracted or unlocked position (FIG. 7) and an extended or locked position in a direction which is transverse to and substantially perpendicular to axis A, said movement shown at Arrow B in FIG. 9 and Arrow C in FIG. 18. Lock finger 42 lays substantially flat against lock reception wall 40 when in its unlocked position (FIG. 7) and angles away from wall 40 when in its locked position so that free end 45 is spaced from wall 40. As shown in FIG. 9, each lock finger 42 is biased towards its extended position. In other embodiments of the invention, secondary spring elements may be used to bias the lock fingers toward the locked position as shown in FIG. 9. In the exemplary embodiment, the bent material, preferably a spring metal, of lock finger 42 and frame 44 provides the resilient force. In FIG. 4, lock slide 26 is connected to first jaw 20 in a manner that allows lock slide 26 to slide back and forth with respect to first jaw 20 between locked and unlocked positions when lock 28 is in its unlocked position.

Figure 5:
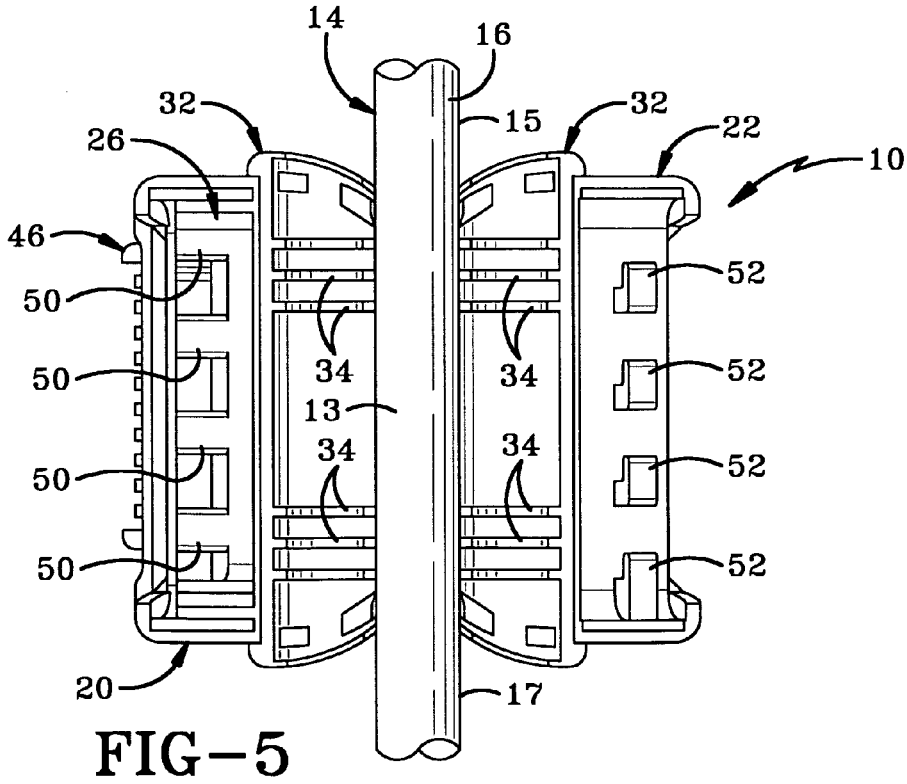
FIG. 5 is an elevation view of the theft deterrent device showing the device in an open condition adjacent an item of merchandise.
Figure 6:
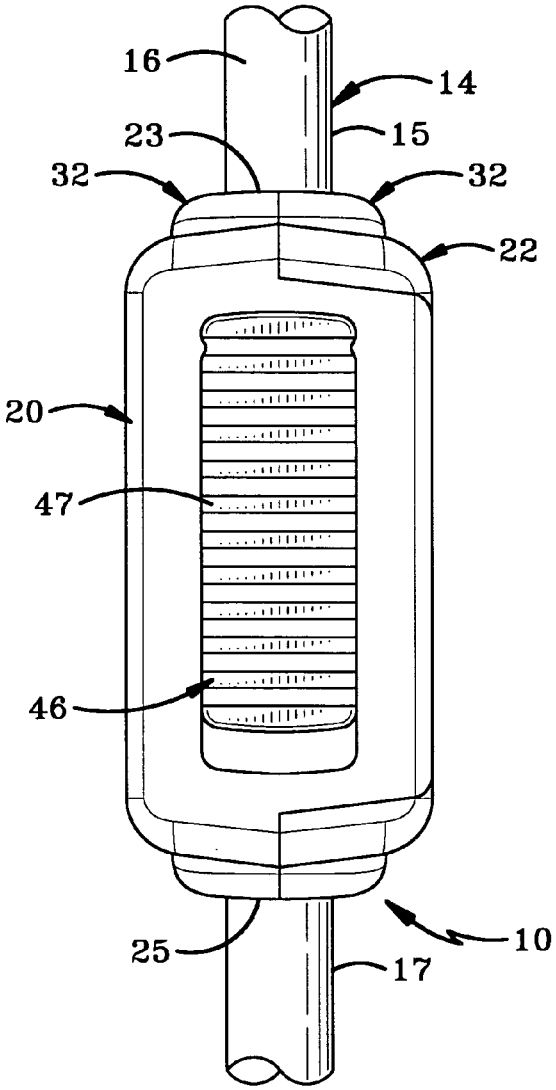
FIG. 6 is a bottom plan view of the theft deterrent device when the jaws are closed onto an item of merchandise and the device is unlocked.

An externally accessible thumb grip 46 is shown in FIGS. 4 and 5. Thumb grip 46 has a gripping surface 47 which is externally accessible when jaws 20 and 22 are in the closed position (FIG. 6). Thumb grip 46 defines an interior chamber 49 which opens in a direction away from gripping surface 47 and in which EAS tag 12 is disposed. Thumb grip includes a plurality of connecting tabs 57 which are disposed on the opposite side of interior chamber 49 from surface 47 and which extend away from surface 47. Thumb grip 46 is connected via tabs 57 by a snap fit engagement to lock slide 26 (FIG. 13), thereby operatively engaging lock slide 26 to allow the user to easily manipulate lock slide 26 from outside of device 10 as shown in FIGS. 6-9 to move lock slide 26 between its locked and unlocked positions. Lock slide 26 is movable via thumb grip 46 from the unlocked position to the locked position without use of key 30. Each of thumb grip 46 and lock slide 26 slides in a linear direction substantially parallel to axis A, as shown by Arrow D in FIG. 8 regarding thumb grip 46 and Arrow E in FIG. 9 regarding lock slide 26.

Figure 7:
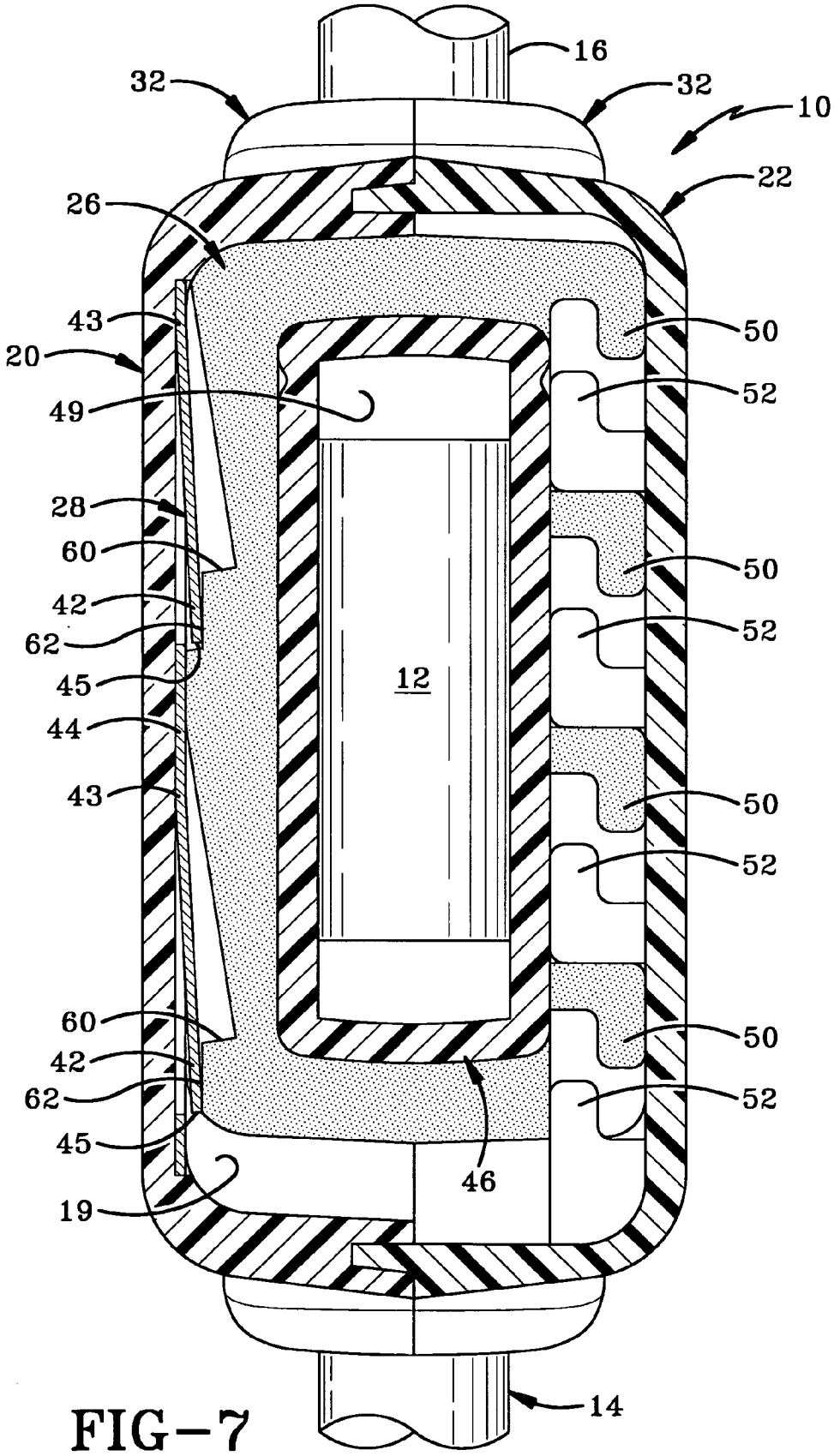
FIG. 7 is a section view of the lock mechanism showing the unlocked condition of the lock slide.

With reference to FIG. 7, Lock slide 26 includes at least one lock hook 50 and second jaw 22 includes at least one corresponding lock hook 52. Hooks 50 and 52 cooperate by engaging one another to hold jaws 20 and 22 together in the locked position when lock slide 26 is in the locked position shown in FIG. 9. In the exemplary embodiment of the invention, there are four lock hooks 50 extending from lock slide 26 and four lock hooks 52 extending from second jaw 22. More particularly, lock slide 26 has first and second substantially parallel opposed sides 51 and 53 with lock hooks 50 disposed along first side 51.

Figure 16:
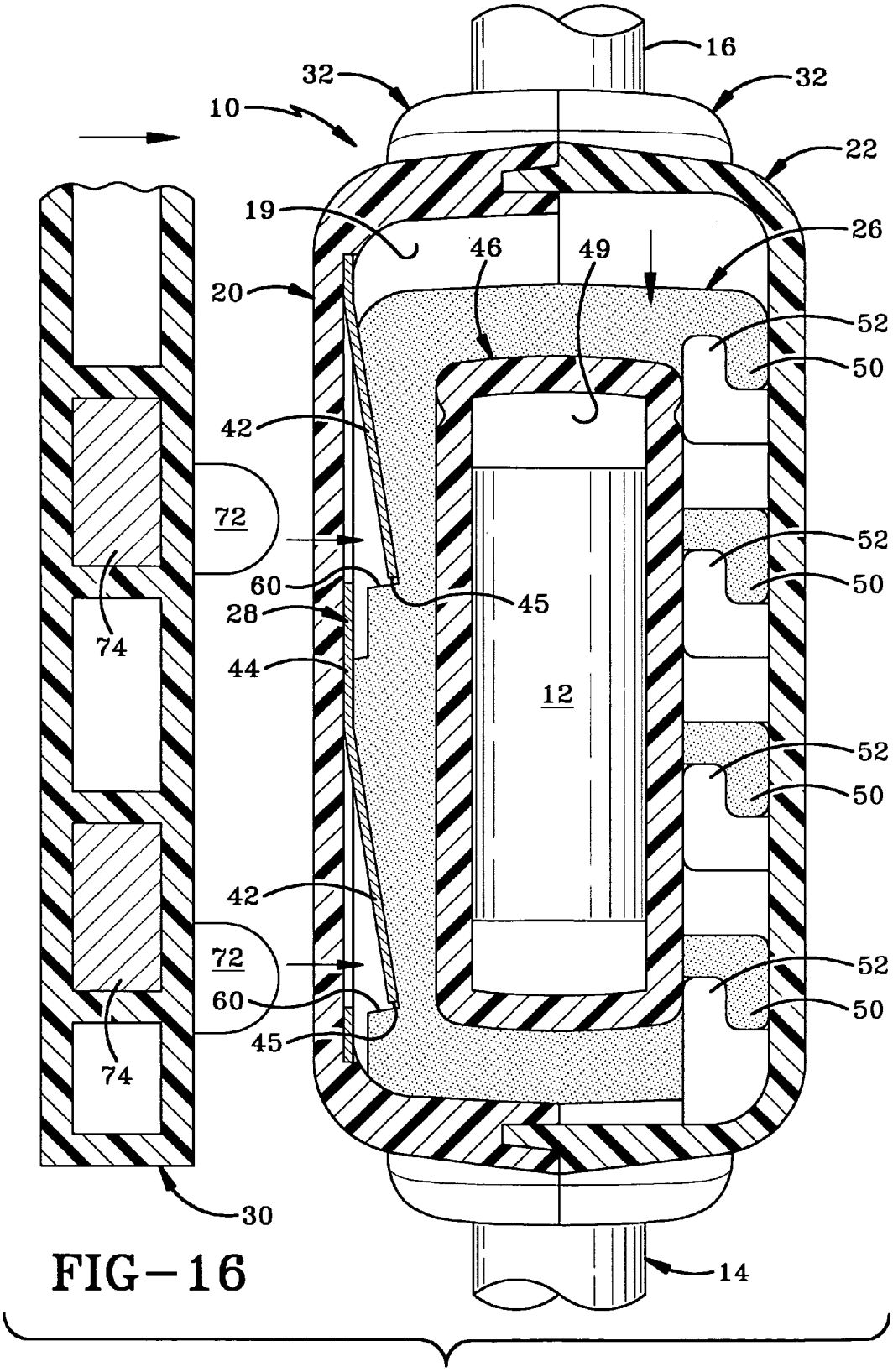
FIG. 16 is a section view similar to FIG. 7 showing the key being aligned with the lock.
Figure 20:
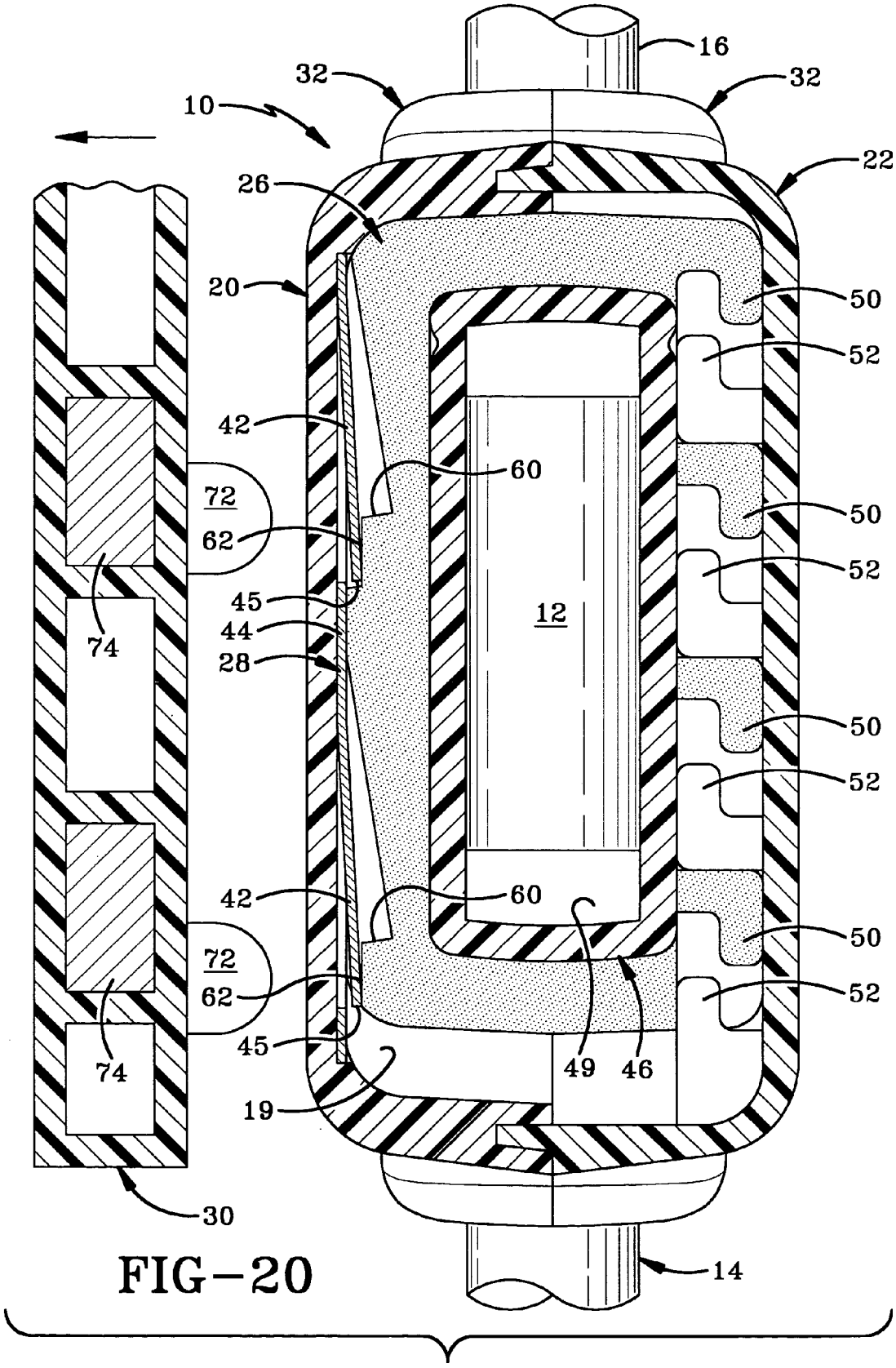
FIG. 20 is a view similar to FIG. 19 showing the key being removed from the theft deterrent device with the lock fingers secured in the unlocked position.

Lock slide 26 includes a locking ledge 60 and an unlocking ledge 62 for each lock finger 42 extending from lock 28. Locking ledges 60 and unlocking ledges 62 are disposed along second side 53 of lock slide 26. Unlocking ledges 62 are used to retain respective locking fingers 42 in their respective unlocked positions when lock slide 26 is in its unlocked position, as shown in FIGS. 7 and 20. Locking ledge 60 is used to engage free end 45 of lock finger 42 to prevent lock slide 26 from moving from the locked position to the unlocked position when lock fingers 42 are in their respective locked positions as depicted in FIGS. 9 and 16. Lock slide 26 defines a central opening 55 which is disposed between lock hooks 50 and ledges 60 and 62 (FIGS. 2 and 3). A portion of thumb grip 46 is disposed within central opening 55.

Figure 8:
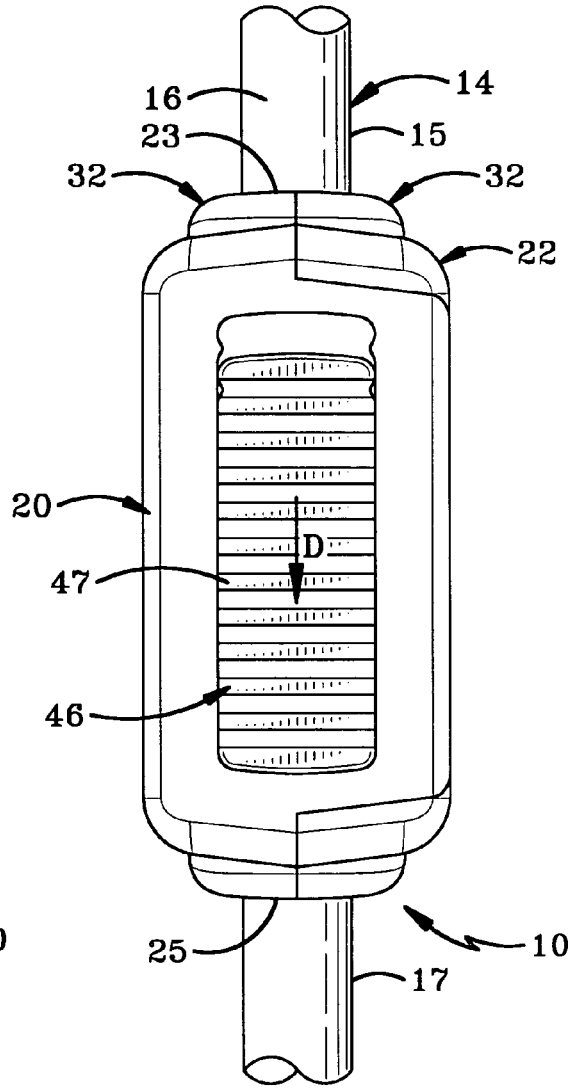
FIG. 8 is a view similar to FIG. 6 showing the lock slide being moved to the locked position.
Figure 15:
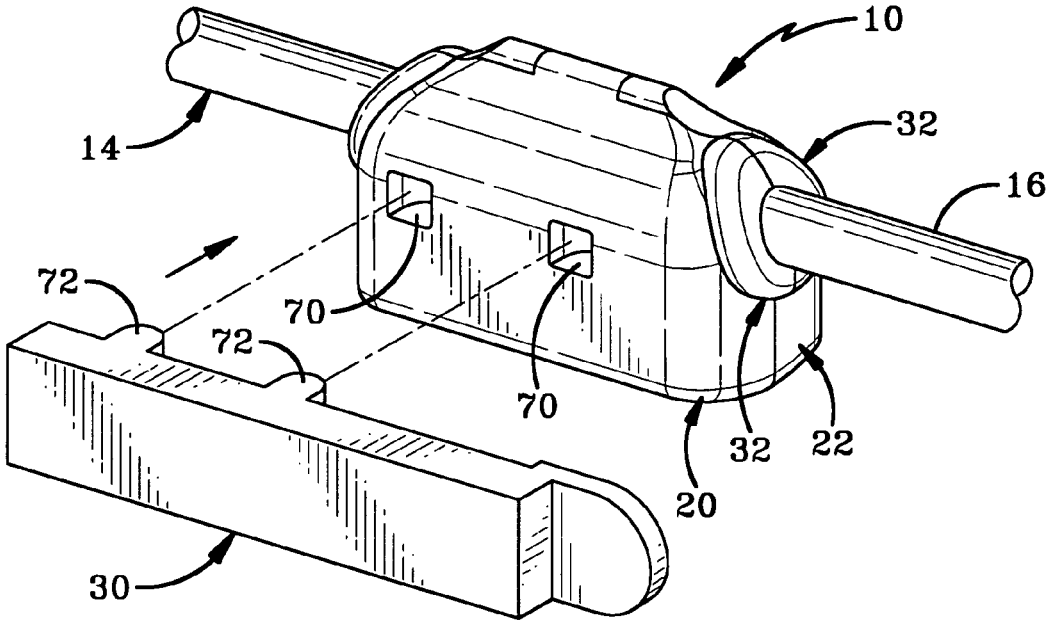
FIG. 15 is a perspective view showing the key used to unlock the theft deterrent device being aligned with the key prong openings defined by the side of one of the jaws.
Figure 17:
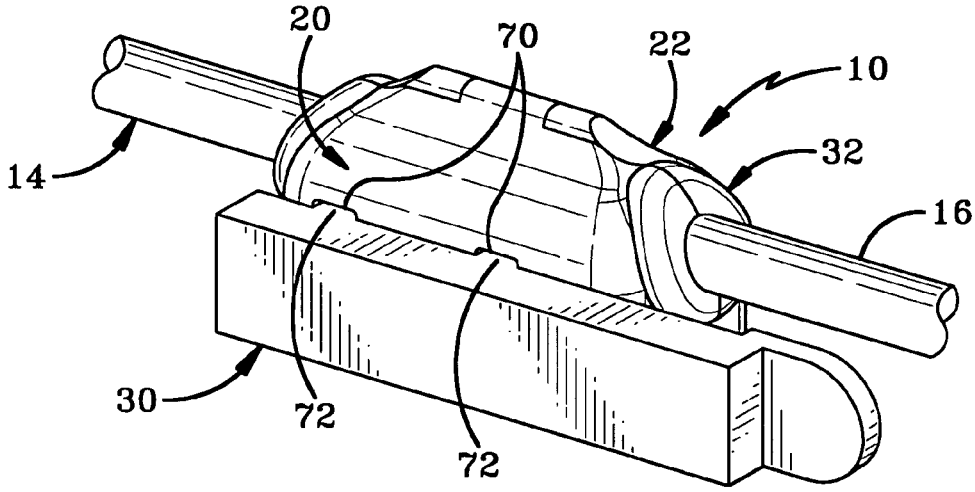
FIG. 17 is a view similar to FIG. 15 showing the key engaging the theft deterrent device.
Figure 18:
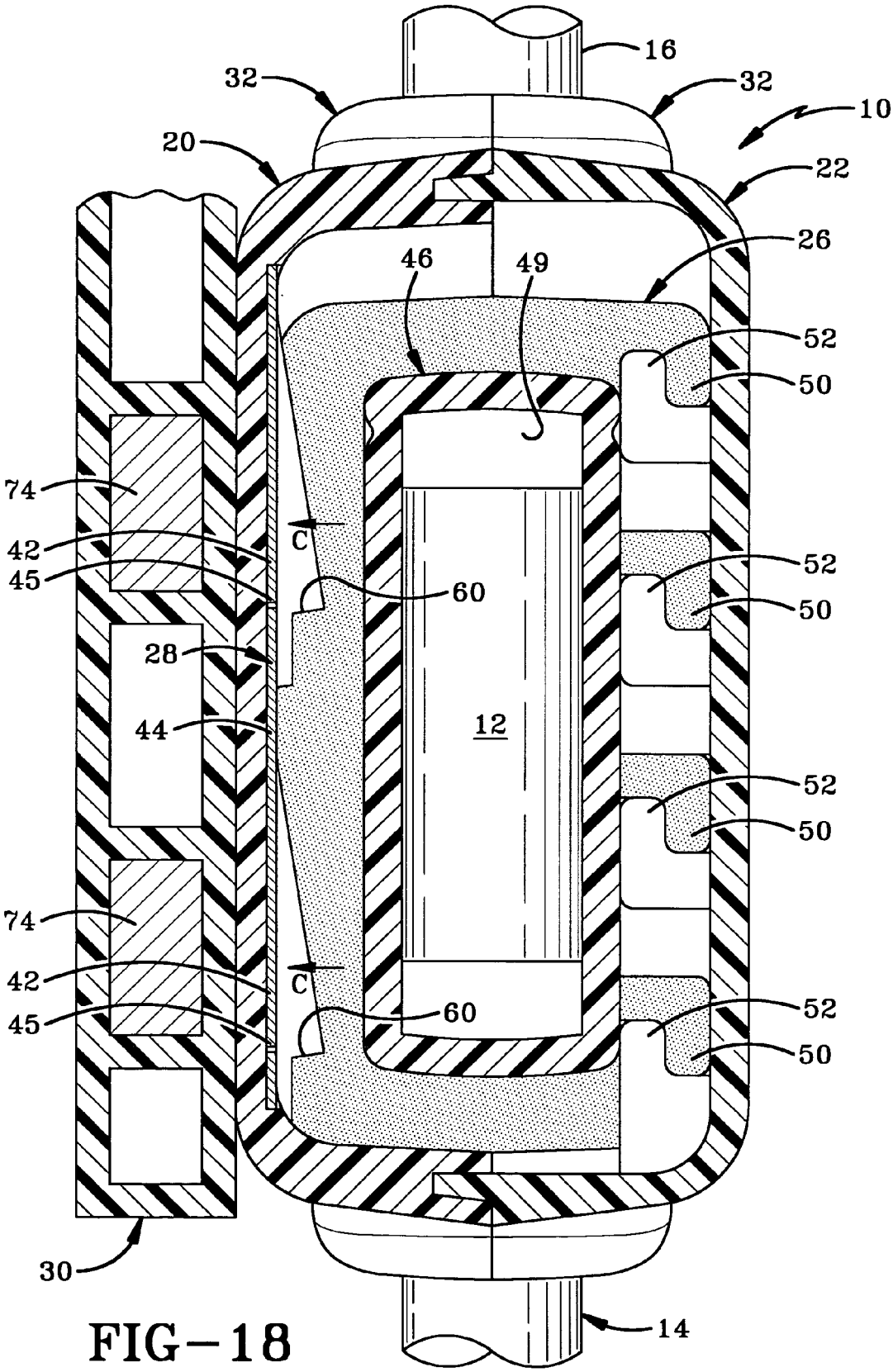
FIG. 18 is a view similar to FIG. 16 showing the locking fingers moved to the unlocked position.
Figure 19:
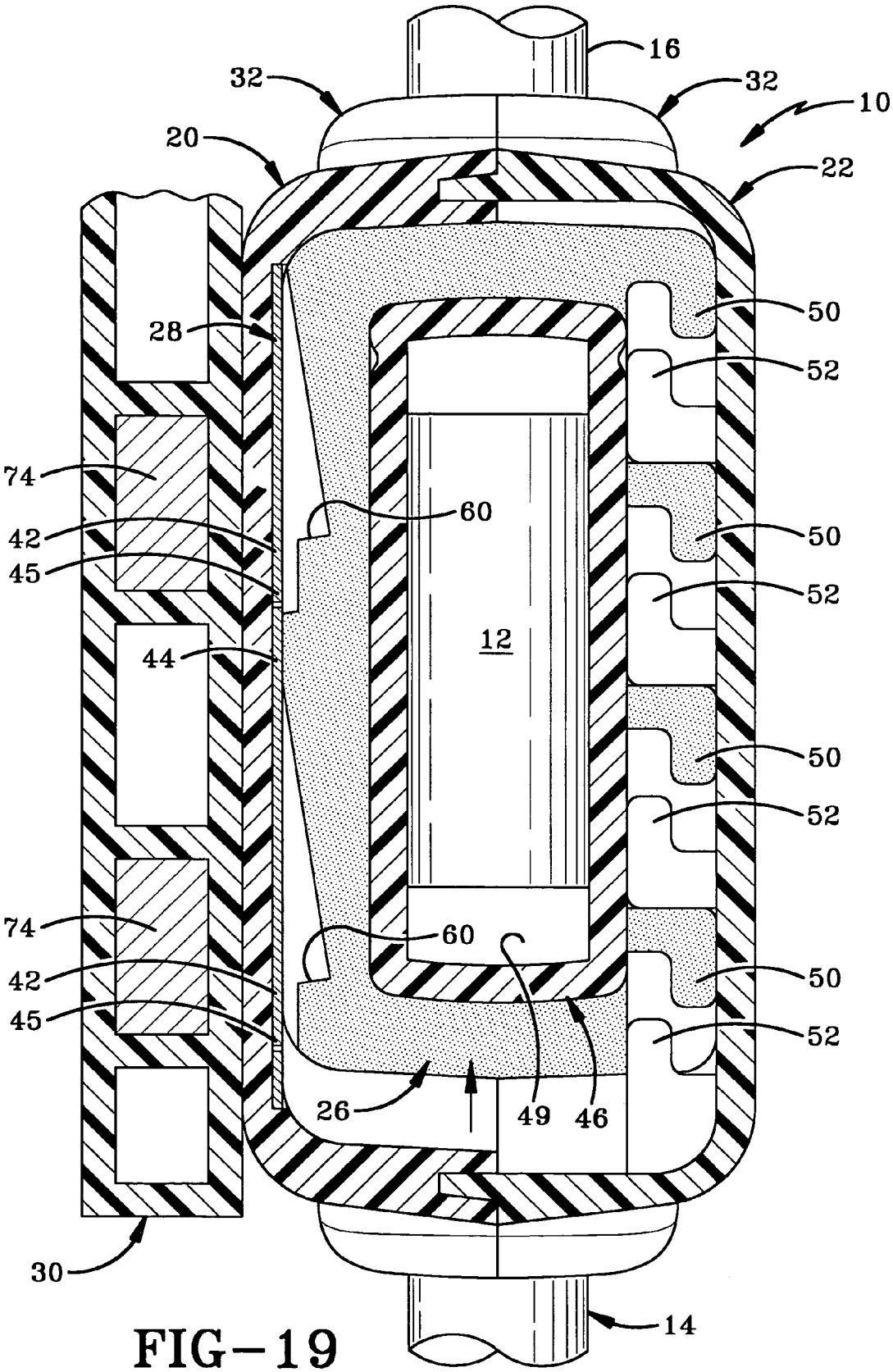
FIG. 19 is a view similar to FIG. 18 showing the lock slide moved to the unlocked position.
Figure 21:
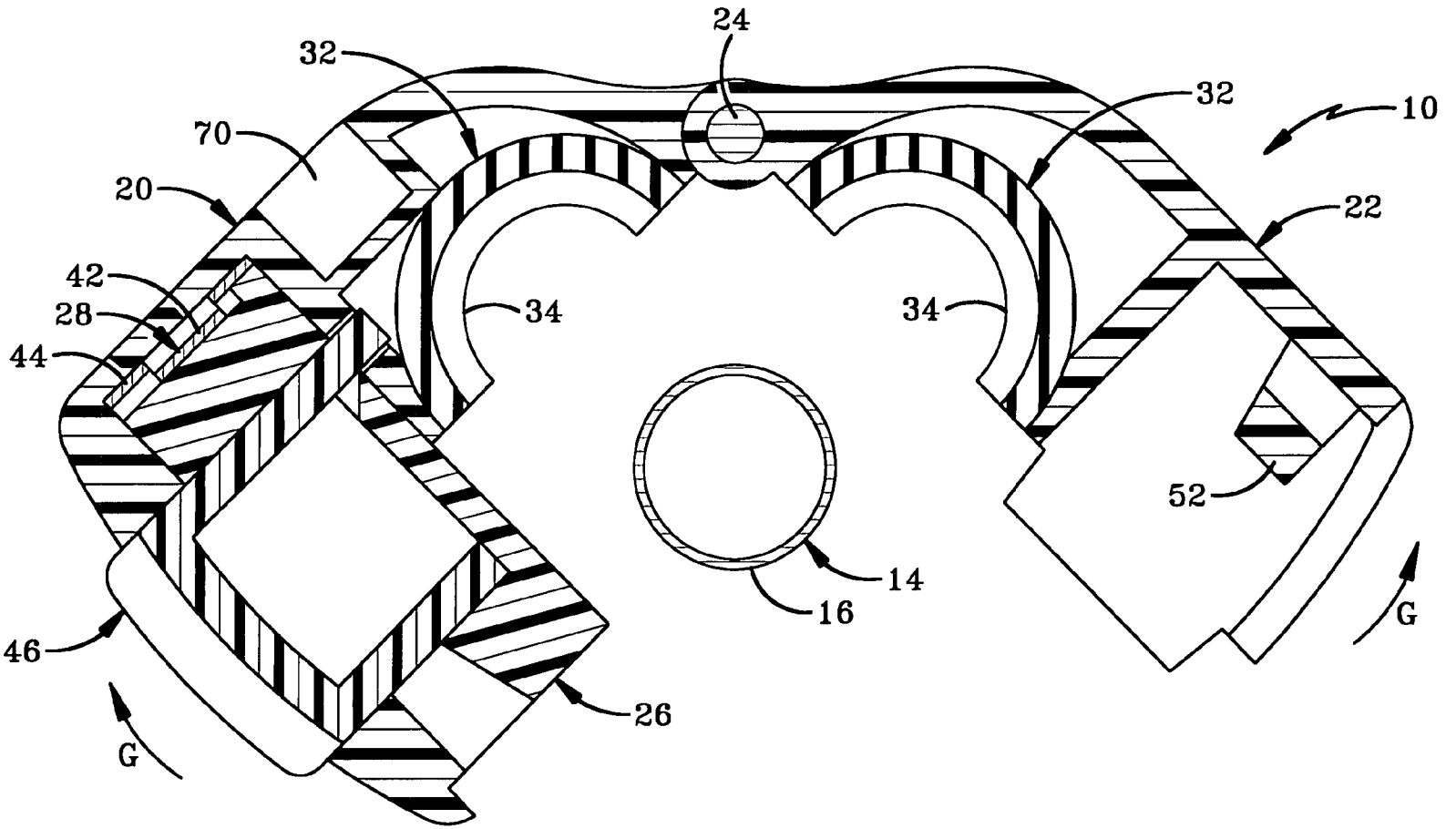
FIG. 21 is a sectional end view showing the theft deterrent device being opened so that the item of merchandise may be removed from the theft deterrent device.

Device 10 may thus be opened as shown in FIG. 5 and clamped around item 14 when lock slide 26 is in its unlocked position. This condition is shown in FIGS. 6 and 7. The user then manipulates thumb grip 46 to move lock slide 26 to the locked position as shown in FIGS. 8 and 9. Lock slide 26 moves towards the locked position until each lock finger 42 clears ledge 62 and automatically snaps towards its locked position against lock ledge 60 such that lock slide 26 cannot be moved back towards the unlocked position until lock fingers 42 are moved towards their unlocked position. In this position, hooks 50 and 52 are securely engaged (FIGS. 9, 16) to prevent jaws 20 and 22 from being opened. First jaw 20 optionally includes key prong openings 70 that allow a user to easily align key 30 with item 10 as shown in FIGS. 15-17. These figures show key prongs 72 being aligned with and snapped into openings 70 so that the magnets 74 carried by key 30 are properly aligned with lock fingers 42. When key 30 is positioned as shown in FIGS. 17 and 18, magnets 74 magnetically attract lock fingers 42 to the unlocked position so that the user may push lock slide 26 as shown at Arrow F in FIG. 19 back to its unlocked position by manipulating thumb grip 46. This condition is shown in FIG. 19 where hooks 50 and 52 are detached from each other and lock fingers 42 are disposed above unlocking ledges 62. The user then removes key 30 from device 10 and lock fingers 42 are biased outwardly against ledge 62. The user may then pivot open jaws 20 and 22 as shown at Arrows G in FIG. 21 to remove item 14 from device 10.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

The invention claimed is:

1. A theft deterrent device comprising:

first and second jaws pivotally connected to one another and pivotally movable between open and closed positions;

wherein the jaws cooperate when in the closed position to define an interior chamber and a through passage adapted to receive therethrough a portion of an article of merchandise;

a lock slide disposed within the interior chamber and carried by the first jaw;

wherein the lock slide is slidable between locked and unlocked positions;

a lock for selectively locking the lock slide in its locked position to lockably secure the first and second jaws together in the closed position;

a thumb grip externally accessible when the device is locked and which operatively engages the lock slide so that the lock slide is movable between the locked and unlocked positions in response to movement of the thumb grip; and wherein the lock slide defines an central opening, with a portion of the thumb grip being disposed within said central opening.

2. The device of claim 1 wherein the lock includes at least one lock finger which is movable between locked and unlocked positions.

3. The device of claim 2 wherein the lock slide includes a locking ledge which engages the lock finger in the locked position to prevent the lock slide from sliding out of the locked position.

4. The device of claim 3 wherein the lock slide includes an unlocking ledge which retains the lock finger in an unlocked position when the lock slide is in the unlocked position.

5. The device of claim 3 wherein the lock finger is resilient and biased toward the locked position.

6. The device of claim 2 wherein the at least one lock finger is substantially flat and has a free end; wherein the second jaw has a lock reception wall which is substantially flat; wherein the at least one lock finger lays substantially flat against the lock reception wall when the lock finger is in its unlocked position; and wherein the at least one lock finger angles away from the lock reception wall when in its locked position so that the free end thereof is spaced from the lock reception wall.

7. The device of claim 2 wherein the lock slide includes a locking ledge; and wherein the lock finger is cantilevered and has a free end which engages the locking ledge in the locked position of the lock finger to prevent the lock slide from sliding out of the locked position.

8. The device of claim 2 wherein the lock slide has first and second opposed sides; wherein the lock slide includes a locking ledge disposed along the first side for engaging the lock finger in the locked position; wherein the lock slide includes at least one lock hook disposed along the second side; and wherein the second jaw includes at least one lock hook for engaging the at least one lock hook of the lock slide to hold the first and second jaws together when the lock slide is in the locked position.

9. The device of claim 2 wherein the first and second jaws are pivotable about an axis between the open and closed positions; and wherein the lock slide is slidable between its locked and unlocked positions along a path substantially parallel to the axis.

10. the device of claim 1 wherein the lock includes at least one lock finger which automatically moves to a locked position when the lock slide moves from its unlocked position to its locked position.

11. The device of claim 1 wherein the lock includes a lock finger which engages a locking ledge of the lock slide when the lock slide is in the locked position.

12. The device of claim 11 wherein the lock slide is linearly movable in a first direction between its locked and unlocked positions; and wherein the lock finger is movable between its locked and unlocked position in a second direction transverse to the first direction.

13. The device of claim 1 wherein each of the second jaw and the lock slide includes at least one lock hook which cooperate together to hold the first and second jaws together when the lock slide is in the locked position.

14. The device of claim 1 wherein the lock is magnetically unlockable.

15. A theft deterrent device comprising:

first and second jaws pivotally connected to one another and pivotally movable between open and closed positions;

wherein the jaws cooperate when in the closed position to define an interior chamber and a through passage adapted to receive therethrough a portion of an article of merchandise;

a lock slide disposed within the interior chamber and carried by the first jaw;

wherein the lock slide is slidable between locked and unlocked positions;

a lock for selectively locking the lock slide in its locked position to lockably secure the first and second jaws together in the closed position; and a thumb grip externally accessible when the device is locked and which operatively engages the lock slide for moving said lock slide between locked and unlocked positions, and wherein the thumb grip defines an interior chamber in which an EAS tag is disposed.

16. A theft deterrent device comprising:

first and second jaws pivotally connected to one another and pivotally movable between open and closed positions, said second jaw including at least one lock hook, and said jaws cooperating when in the closed position to define an interior chamber and a through passage adapted to receive therethrough a portion of an article of merchandise;

a lock slide disposed within the interior chamber and carried by the first jaw and slidable between locked and unlocked positions, said lock slide having first and second opposed sides with a locking ledge disposed along the first side and at least one lock hook disposed along the second side, said one lock hook on the slide lock engages the at least one lock hook on the second jaw to hold the first and second jaws together when the lock slide is in the locked position; and a lock for selectively locking the lock slide in its locked position, said lock including at least one lock finger movable between locked and unlocked positions and engaging the locking ledge in the locked position to lockably secure the first and second jaws together in the closed position.

17. The device of claim 16 further including a thumb grip which is externally accessible when the device is locked and which operatively engages the lock slide so that the lock slide is movable between its locked and unlocked positions in response to movement of the thumb grip.

18. The device of claim 17 wherein the thumb grip defines an interior chamber in which an EAS tag is disposed.

19. The device of claim 17 wherein the lock slide is movable via the thumb grip from the unlocked position to the locked position without use of a key that unlocks the device.

20. A theft deterrent device comprising:

first and second jaws pivotally connected to one another and pivotally movable between open and closed positions, said jaws cooperating when in the closed position to define an interior chamber and a through passage adapted to receive a portion of an article of merchandise;

a lock slide disposed within the interior chamber and carried by the first jaw and slidable between locked and unlocked positions, said lock slide having a locking ledge and at least one lock hook for locking engagement with at least one lock hook formed on the second jaw;

a lock for locking the lock slide in the locked position to secure the first and second jaws together in the closed position, said lock having at least one magnetically attractable lock finger which automatically moves to a locked position with the locking ledge of the lock slide when the lock slide moves from unlocked position to locked position;

an externally accessible thumb grip operatively engaging the lock slide for moving the lock slide between locked and unlocked positions; and a magnetic key positionable exteriorly on the first jaw adjacent the magnetically attractable lock finger to move said lock finger to the unlocked position.

21. The device of claim 20 wherein the lock slide defines a central opening; and wherein a portion of the thumb grip is disposed within the central opening.

* * * * *